US009704324B2

(12) United States Patent
Nunn

(10) Patent No.: US 9,704,324 B2
(45) Date of Patent: Jul. 11, 2017

(54) DOCUMENT HANDLING DEVICE

(75) Inventor: Michael D. Nunn, West Chester, PA (US)

(73) Assignee: Crane Payment Innovations, Inc., Malvern, PA (US)

( * ) Notice: Subject to any disclaimer, the term of this patent is extended or adjusted under 35 U.S.C. 154(b) by 859 days.

(21) Appl. No.: 12/666,607

(22) PCT Filed: Jun. 27, 2008

(86) PCT No.: PCT/US2008/068470

§ 371 (c)(1),
(2), (4) Date: Nov. 15, 2010

(87) PCT Pub. No.: WO2009/003152

PCT Pub. Date: Dec. 31, 2008

(65) Prior Publication Data

US 2011/0093116 A1 Apr. 21, 2011

Related U.S. Application Data

(60) Provisional application No. 60/937,486, filed on Jun. 27, 2007.

(51) Int. Cl.
*G07F 7/04* (2006.01)
*G07D 11/00* (2006.01)
(Continued)

(52) U.S. Cl.
CPC ..... *G07D 11/0003* (2013.01); *B65H 7/12* (2013.01); *B65H 7/125* (2013.01); *B65H 29/00* (2013.01);
(Continued)

(58) Field of Classification Search
CPC B65H 2301/42144; B65H 7/125; B65H 7/12; B65H 83/00; B65H 85/00; B65H 2513/10; B65H 29/68; B65H 5/34; B65H 2701/1912; B65H 29/00; B65H 2553/00; B65H 29/66; B65H 29/6645; B65H 69/669; B65H 31/00; G07D 7/00; G07D 7/12; G07D 7/06; G07D 11/00; G07D 11/0003;
(Continued)

(56) References Cited

U.S. PATENT DOCUMENTS 4,398,088 A 8/1983 Hirose et al.
4,625,870 A 12/1986 Nao et al.
(Continued)

FOREIGN PATENT DOCUMENTS

DE 195 36 481 A1 3/1997
EP 0 317 537 A2 5/1989
(Continued)

*Primary Examiner* — Jeffrey Shapiro

(57) ABSTRACT

A money handling device for accepting, storing and dispensing valuable documents in exchange for goods or services includes a validation module (100), a recycler module (200) and a note storage module (300). The validation module determines acceptable and non-acceptable valuable documents, and the storage module stores acceptable valuable documents. The recycler is arranged to dispense a temporarily stored valuable document to the validation module for dispensing as change or to dispense a temporarily stored valuable document to the note storage module.

14 Claims, 10 Drawing Sheets

(51) Int. Cl.

| | |
|---|---|
| ***B65H 7/12*** | (2006.01) |
| ***B65H 85/00*** | (2006.01) |
| ***B65H 29/00*** | (2006.01) |
| ***B65H 31/00*** | (2006.01) |
| ***B65H 29/68*** | (2006.01) |
| ***G07D 7/00*** | (2016.01) |

(52) U.S. Cl.

CPC ..... *B65H 29/006* (2013.01); *B65H 29/68* (2013.01); *B65H 31/00* (2013.01); *B65H 85/00* (2013.01); *G07D 7/00* (2013.01); *G07D 11/00* (2013.01); *G07D 11/0006* (2013.01); *G07D 11/0018* (2013.01); *G07D 11/0021* (2013.01); *G07D 11/0024* (2013.01); *G07D 11/0033* (2013.01); *G07D 11/0081* (2013.01); *G07D 11/0084* (2013.01); *G07D 11/0087* (2013.01); *B65H 2301/41912* (2013.01); *B65H 2301/42144* (2013.01); *B65H 2513/10* (2013.01); *B65H 2701/1912* (2013.01); *G07D 2207/00* (2013.01); *G07D 2211/00* (2013.01)

(58) Field of Classification Search

CPC ..... G07D 11/0006; G07D 11/0009; G07D 11/0012; G07D 11/0021; G07D 11/0024; G07D 11/0045; G07D 11/0051; G07D 11/0057; G07D 11/006; G07D 11/0063; G07D 11/0066; G07D 11/0069; G07D 11/0072; G07D 11/0075; G07D 11/0084; G07F 7/04; G07F 19/00; G07F 19/20; G07F 19/201; G07F 19/205; G07F 19/207; G07F 19/209; G06Q 10/06; G06Q 20/10; G06Q 20/204; G06Q 30/08; G06Q 40/00; G06Q 40/02; G06Q 40/04; G06Q 40/06; G06Q 40/025; G06Q 20/108; G06Q 20/1085; G06K 7/10415; Y10S 902/00; Y10S 902/08; B07C 5/34

USPC ..... 194/206, 207; 209/534; 235/379; 271/176, 216, 3.01, 3.03, 270; 705/35, 705/39, 42, 43

See application file for complete search history.

(56) References Cited

U.S. PATENT DOCUMENTS

| | | | | |
|---|---|---|---|---|
| 4,744,468 | A | 5/1988 | Goi et al. | |
| 6,006,209 | A | 12/1999 | Takeuchi et al. | |
| 6,040,584 | A | 3/2000 | Liu et al. | |
| 6,371,473 | B1 * | 4/2002 | Saltsov | B65H 29/006 194/206 |
| 6,422,458 | B1 | 7/2002 | Katou et al. | |
| 6,538,759 | B1 * | 3/2003 | Hiraishi | H04N 1/00843 209/534 |
| 6,581,746 | B1 * | 6/2003 | Lundblad | B65H 29/006 194/206 |
| 7,677,546 | B2 | 3/2010 | Saltsov et al. | |
| 2001/0022258 | A1 * | 9/2001 | Satou | B65H 29/006 194/206 |
| 2002/0113160 | A1 * | 8/2002 | Niioka | B65H 29/006 242/528 |
| 2002/0162775 | A1 * | 11/2002 | Saltsov et al. | 209/534 |
| 2003/0116400 | A1 * | 6/2003 | Saltsov et al. | 194/207 |
| 2003/0155704 | A1 * | 8/2003 | Polidoro | B65H 29/006 271/216 |
| 2004/0049453 | A1 | 3/2004 | Moreno et al. | |
| 2004/0084521 | A1 * | 5/2004 | Nagayoshi | G07D 11/0051 235/379 |
| 2004/0173708 | A1 * | 9/2004 | Neumann | B65H 18/103 242/412.3 |
| 2005/0017428 | A1 * | 1/2005 | Ichikawa | B65H 5/28 271/3.14 |
| 2006/0037834 | A1 * | 2/2006 | Nago et al. | 194/207 |
| 2006/0214350 | A1 * | 9/2006 | Saltsov et al. | 271/3.01 |
| 2009/0134262 | A1 * | 5/2009 | Elbel | B65H 5/28 242/390.2 |

FOREIGN PATENT DOCUMENTS

| | | |
|---|---|---|
| EP | 1 598 786 | 11/2005 |
| EP | 1 772 406 A1 | 11/2007 |
| EP | 1 363 251 A | 11/2009 |

* cited by examiner

DOCUMENT HANDLING DEVICE

CROSS REFERENCE TO RELATED APPLICATIONS

This application is a national phase filing under 35 U.S.C. §371 of International application number PCT/US2008/0268470, filed Jun. 27, 2008, which claims priority from provisional application No. 60/937,486 filed Jun. 27, 2007. The entire content of the prior applications are incorporated herein by reference in their entirety.

FIELD OF DISCLOSURE

The disclosure relates to a document handling device. In particular, the disclosure relates to the acceptance, storage and dispensing of valuable documents in connection with automated transactions.

BACKGROUND

Automated transaction machines accept and dispense currency to be used as legal tender in exchange for goods or services. Typically automated transactions machines, including but not limited to, vending machines, gaming machines, and automated tellers, include a note validator for checking the authenticity and denomination of inserted notes. As used herein, the term "note" (or "notes") includes, but is not limited to, paper currency such as banknotes, bills, security documents, paper currency checks, coupons, tickets and other documents of value that can be used as legal tender in exchange for goods or services.

In vending machines, the value of vend items tend to rise with inflation. Therefore, there exists a need to be able to accept higher denomination bills. When a customer inserts currency at or above the actual vend prices of an item or items, it may be necessary to dispense change relative to the transaction. Some devices dispense change to a customer in the form of coins and, in some cases, a combination of coins and bills. In devices that dispense change it is particularly important to limit the frequency of service on the machine to replenish the supply of currency available for providing change. One solution to maintaining a supply of currency available for dispensing of change is to use inserted currency for change. For example, transaction machines can recycle coins such that they are temporarily stored within the machine and are made available for later dispensing to customers in the form of change.

SUMMARY

The disclosure relates to a note recycler that can be used with a note validator arranged to check the authenticity and denomination of received notes. The recycler can be removably coupled to a note validation module. The disclosure also relates to a compact banknote recycler module for a money handling device that can be useful in fitting the form factor used in vending and gaming machines. One aspect of the disclosure includes a money handling device processor to control the operation of at least some of the included modules. Various aspects of the invention are set forth in the claims.

The recycler module can be used, for example, to store temporarily—and later dispense—various denominations as required by a given application. In one implementation, the recycler module is located at the exit of the validation module and below the note storage module. The validation module includes a note inlet where notes are inserted into the money handling device and into the validation module. As notes are inserted into the validation module, the authenticity and denomination of the inserted note is verified and notes determined not to be authentic are returned back through the inlet in the validation module. Notes are also returned to the customer through the inlet in the validation module when a transaction is canceled by the customer or by the vending machine.

Notes determined to be authentic are transported from the validation module to the recycler module where they can be stored for later dispensing as change in a transaction, or they can be transported from the recycler module to the note storage module. In some implementations, a diverter is coupled to the validation module to control the transportation of inserted notes. The diverter can be arranged to allow inserted notes to be transported from the validation module to the recycler module. When notes are transported to the recycler module from the validation module, the diverter is in a first position in which the path from the validation module to the recycler module is not blocked and the transportation path from the recycler module to the note storage module is blocked. When inserted notes are selected to be transported to the note storage module, the diverter moves from the first position, blocking the transportation path to the note storage module, to a second position blocking the transportation path between the recycler module and the validation module. Typically a single denomination is stored within the recycler module and all other accepted notes are transported to the note module for storage. In other implementations, the recycler module can store a variety of denominations, and the money handling device can select which inserted notes are stored within the note storage module.

In some implementations, the recycler module is coupled to a validation module which is not long enough to provide an escrow position for inserted notes such that validation of the inserted note cannot be made prior to its exiting from the validation module. In such a configuration the inserted note can be held in an escrow position wholly or partially within the recycler module until the validation module can verify the authenticity and denomination of the inserted note. In other implementations, inserted notes are transported from the validation module to the recycler module where the inserted bill can be either stored within the recycler module, for later dispensing, or the inserted bill can be released from the recycler module and transported to the note storage module.

The transportation path of inserted notes includes the validation module, and the recycler module and, in some configurations, the note storage module. In some implementations, the money handling device can include an escrow position located adjacent the note storage module. Is such a configuration once the money handling device determines the denomination of the inserted note, it can be transported either to the currency storage module or to the recycler module for dispensing as change during a later transaction. When the escrow position is located adjacent the currency storage module, a diverter is coupled to the validation module such that inserted notes can be transported from the validation module to the escrow position adjacent the note storage module. If the inserted note is selected to be stored within the note storage module, a stacker mechanism inserts the note in the escrow position into the currency storage module. When the note in the escrow position adjacent the note storage module is selected to be stored within the recycler module, the diverter is moved from a position blocking transportation of a note from the escrow position adjacent the note storage module to the recycler module, to a position blocking transportation of a note from the escrow position adjacent the note storage module to the recycler module.

In some implementations, the module can be used to up-grade an existing money handling device, with minor modifications, as a set of mechanical inserts. In this and other implementations, it may be necessary to exchange a previous electronic control board for a new electronic control board.

Other aspects and features will be readily apparent from the detailed description, the accompanying drawings and the claims.

DETAILED DESCRIPTION

Figure 1:
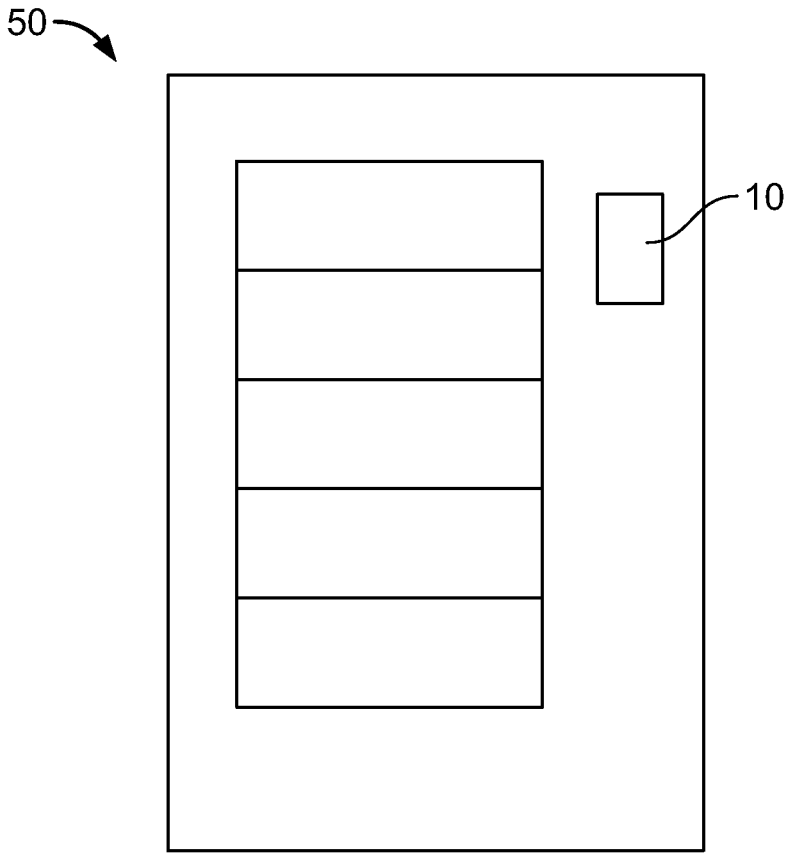
FIG. 1 illustrates an automated transaction machine including a money handling device.
Figure 2:
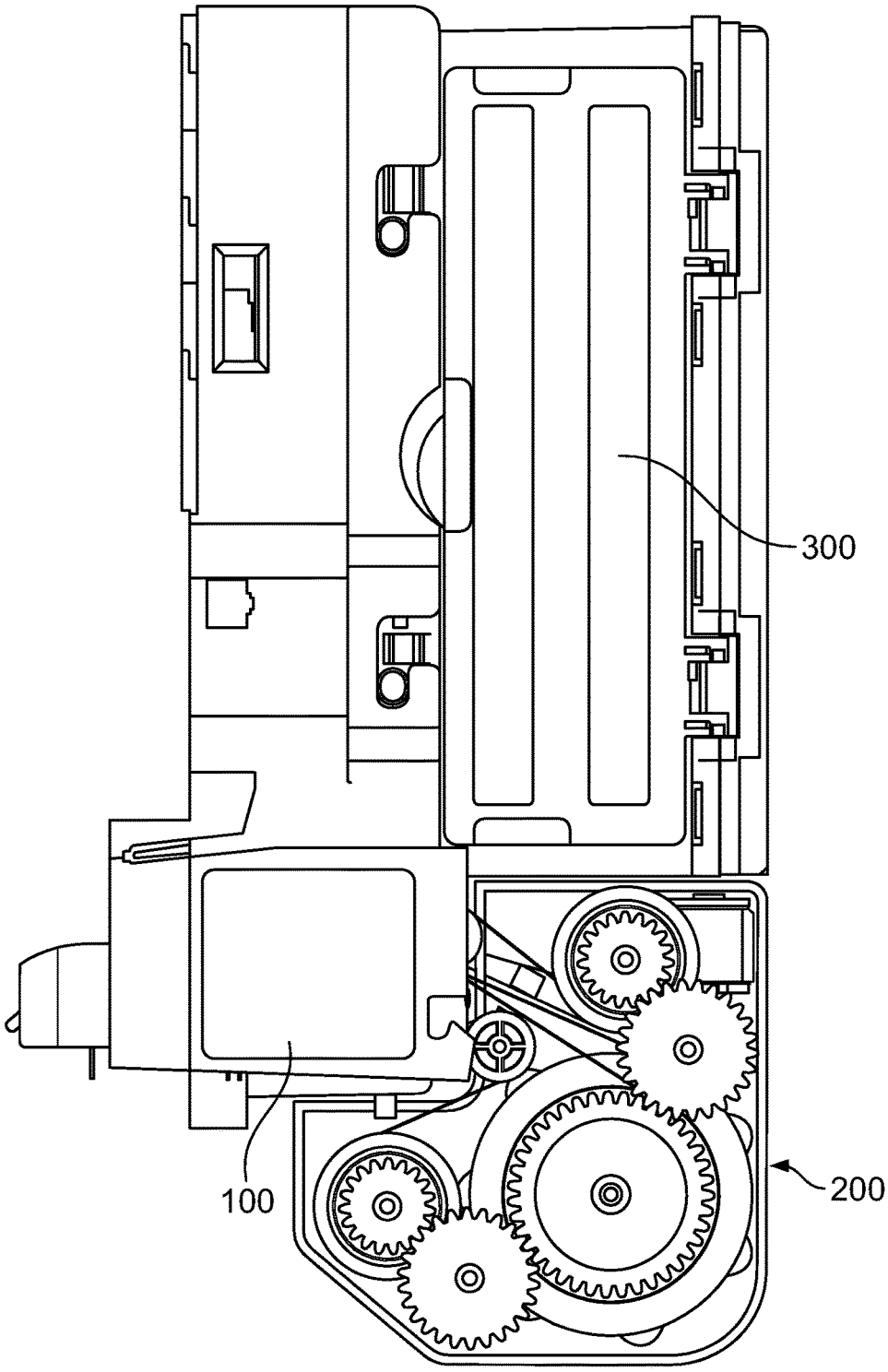
FIG. 2 shows an example of the money handling device including a note recycler.
Figure 3:
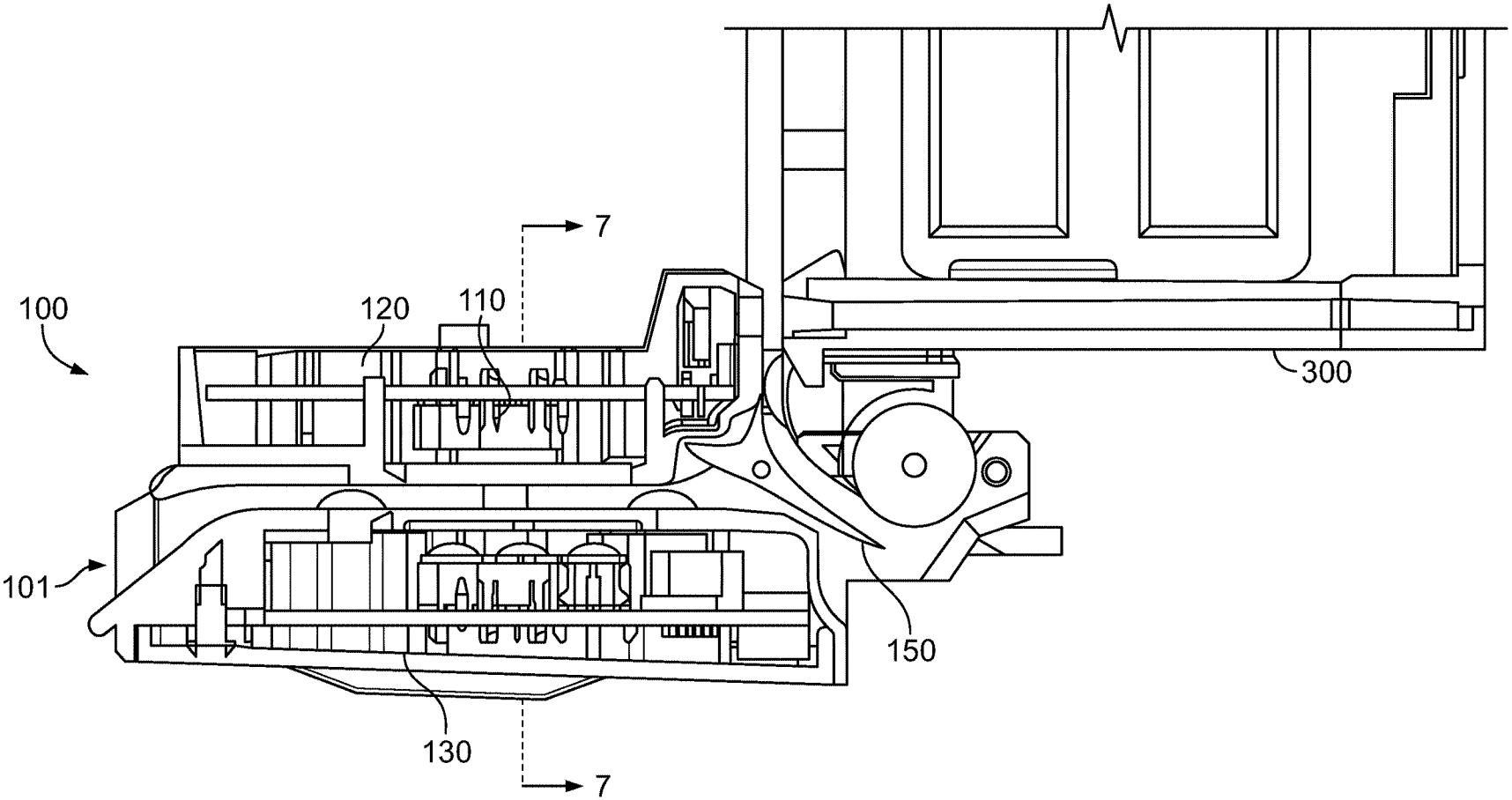
FIGS. 3 and 4 show additional details of the money handling device, including part of the note transport system.
Figure 5:
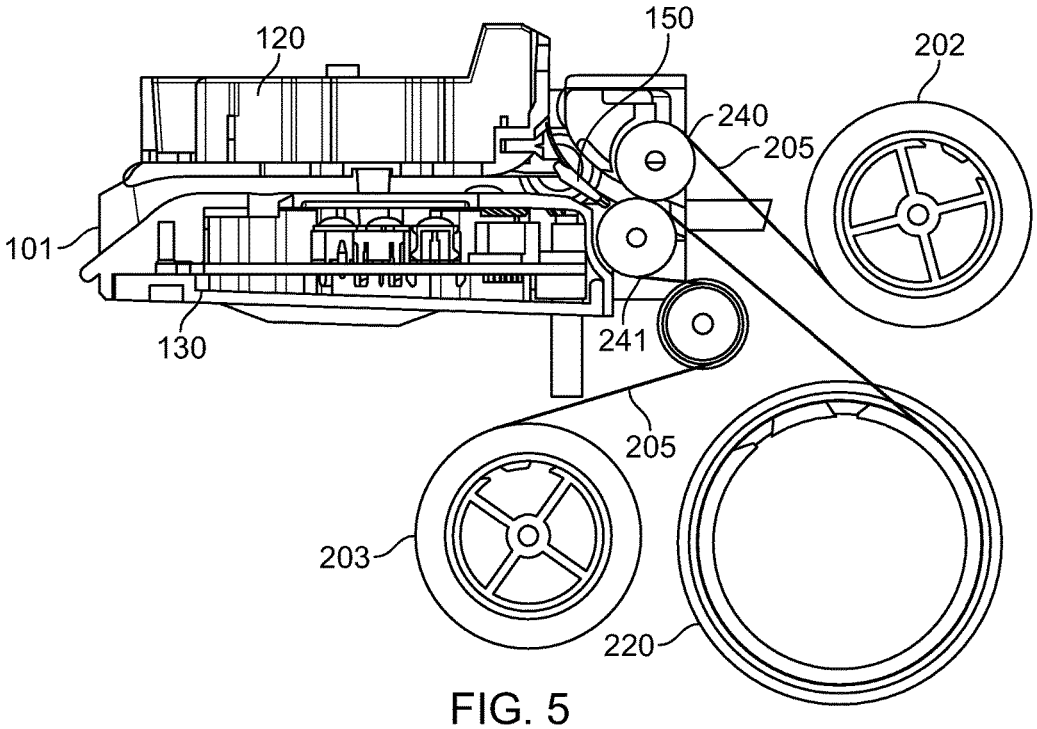
FIG. 5 shows various components for the note recycler.
Figure 6:
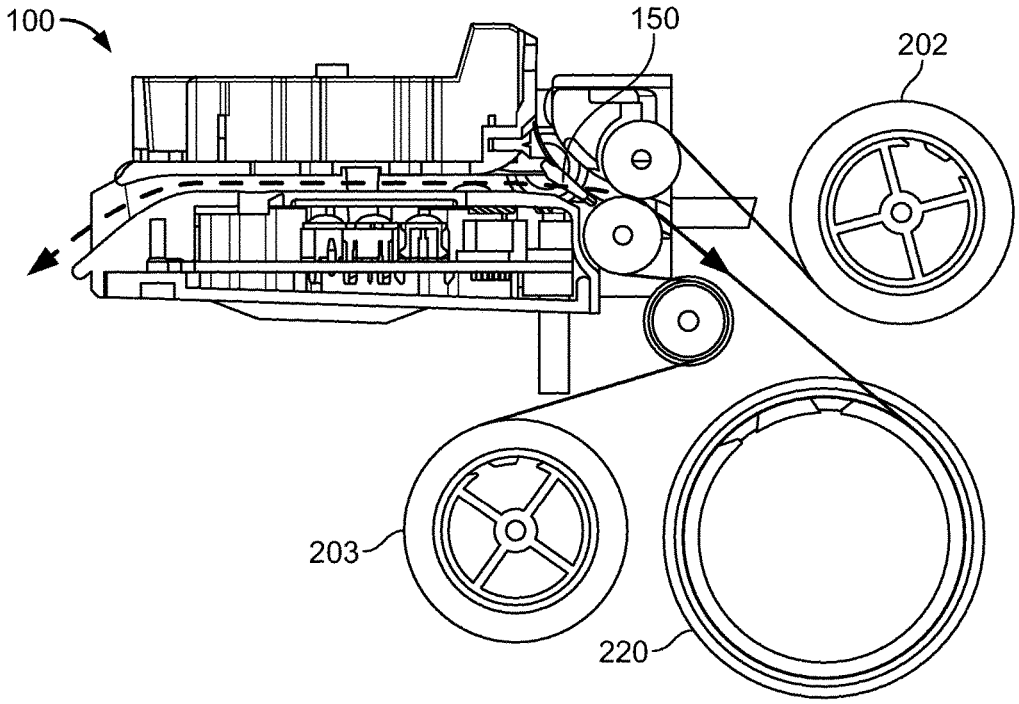
FIG. 6 shows the banknote trajectory when inserted and either escrowed or dispensed.
Figure 7:
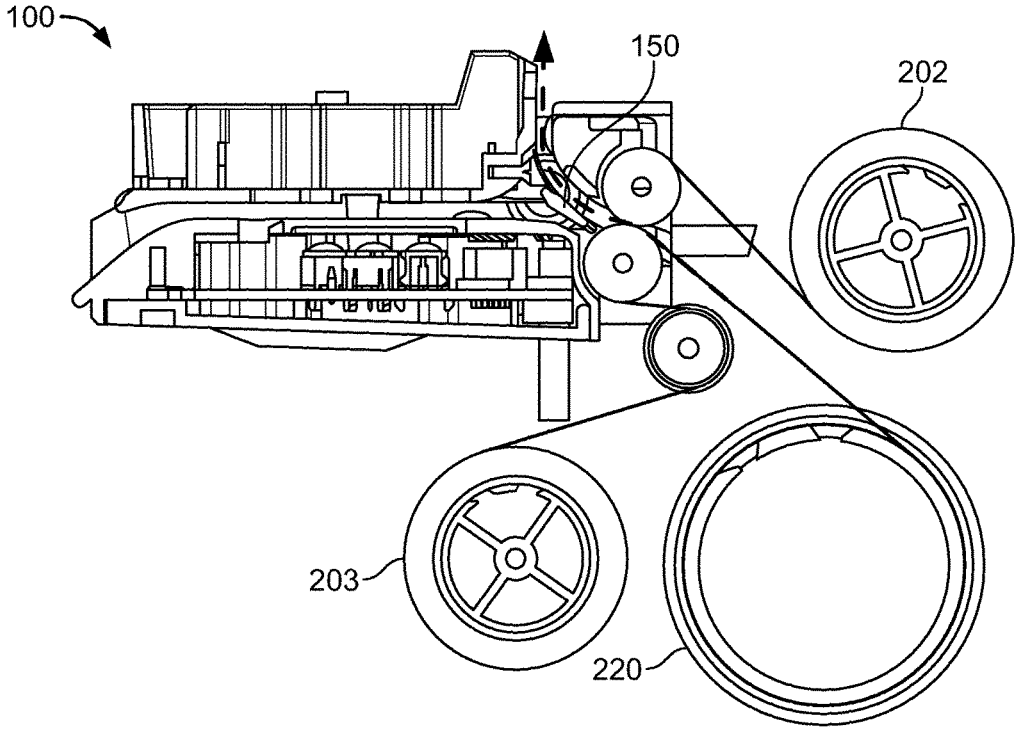
FIG. 7 shows the note trajectory when routed to the stacker and cashbox.
Figure 8:
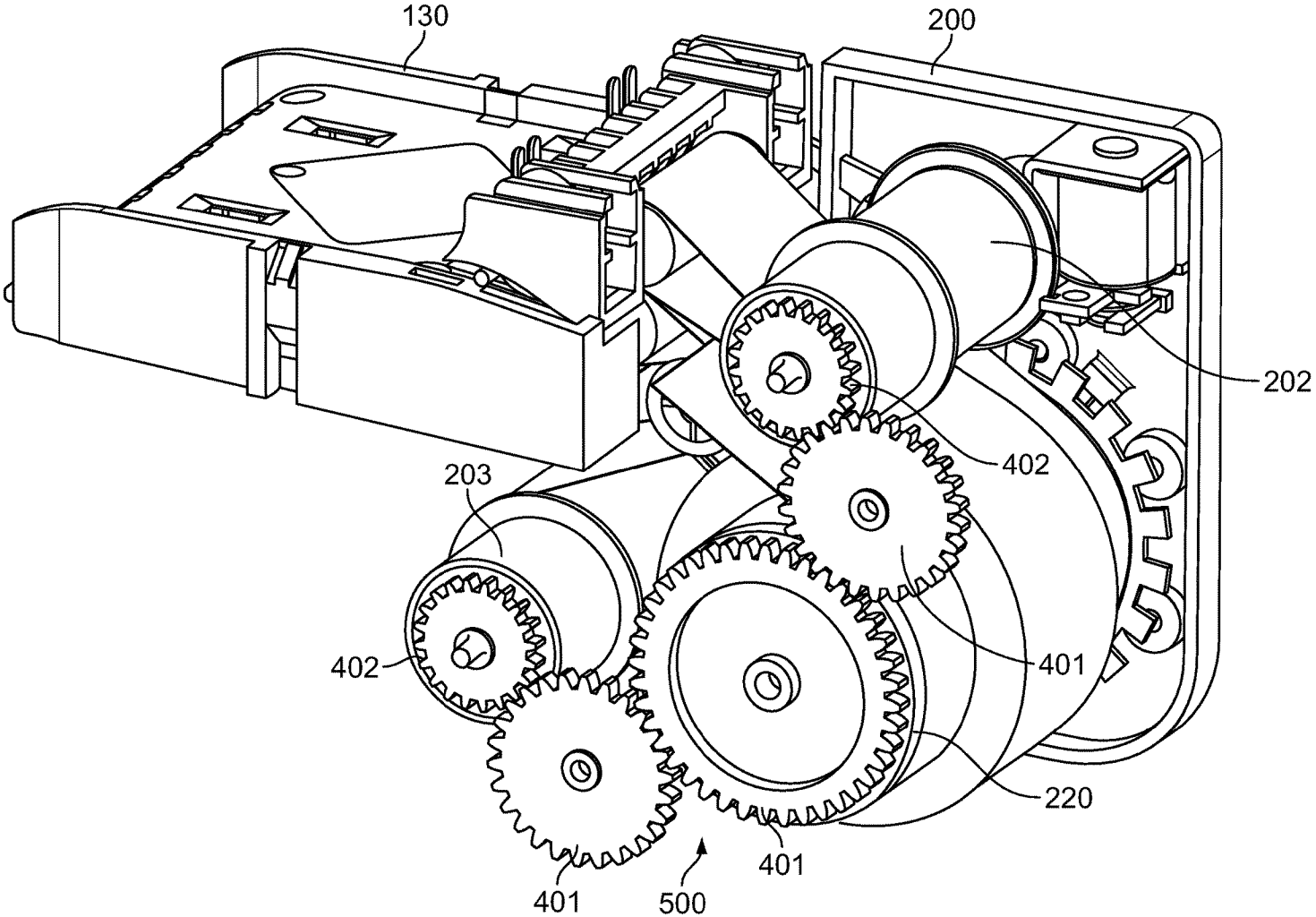
FIG. 8 is a perspective view of the recycler connected to the lower housing of the validation section.
Figure 12:
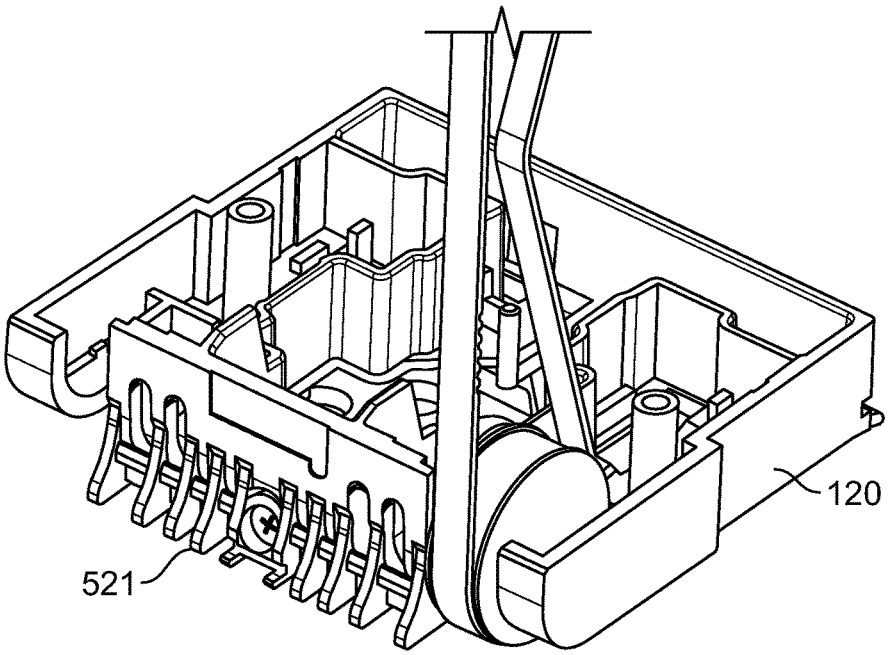
FIG. 12 is detail view of a wedge comb guide attached to the upper housing of the validation section.

As shown in FIG. 1, a money handling device 10 for accepting, storing and dispensing notes is part of an automated transaction machine 50. As shown in the example of FIG. 2, the money handling device 10 includes a note validation module 100, a note recycler module 200 and a note storage module 300. The note validation module 100 is of a type generally known in the art and, in the illustrated example, is similar to the design described in U.S. Pat. No. 5,632,367 (see, e.g., FIGS. 5 and 12 of the patent), which is assigned to MEI, Inc. As illustrated in FIG. 3, validation module 100 includes a validation sensor assembly 110 for testing the authenticity and denomination an inserted note, a transportation mechanism for transporting notes past sensor assembly 110, upper and lower housings 120, 130, and a diverter 150 for controlling the transportation of notes out of validation module 100.

Notes are inserted into validation module 100 at note inlet 101. The transportation mechanism is operable to move notes through the validation module 100 and past sensor assembly 110. Sensor assembly 110 includes an optical sensor arrangement for testing the authenticity and denomination of notes as commonly know in the art. Alternatively, or in addition, sensor assembly 110 may comprise other note sensing components to employ other testing techniques (e.g., magnetic sensing). Notes determined to be authentic are transported from the validation module 100 to the recycler module 200 for temporary storage therein or storage within the note storage module 300. When a note is determined to be non-authentic or the transaction is cancelled by the customer, transportation mechanism 140 is reversed and note is returned to the customer back through note inlet 101.

In some implementations, diverter 150 is pivotally coupled to validation module 100 for selectively blocking passage of a note between validation module 100 and recycler module 200, and recycler module 200 and note storage module 300. In other implementations, diverter 150 is pivotally coupled to validation module 100 for selectively blocking passage of a note between validation module 100 and note storage module 300, and note storage module 300 and recycler module 200.

In some implementations, diverter 150 is pivotally coupled to lower housing 130. Lower housing 130 and diverter 150 are arranged such that diverter 150 is pivotally mounted to lower housing 130. In other implementations, upper housing 120 further includes a mounting insert with a pivot such that diverter 150 can be pivotally coupled thereto for selective movement between first and second positions.

Recycler module 200 is arranged for selectively storing inserted notes and for transporting notes to note storage module 300. In the illustrated example (see FIGS. 5, 6, 7 and 8), note recycler 200 includes take-up spools 202, 203, drum 220, film bands 205, housing 230 and wheels 240, 241. Notes are transported from the exit of validation module 100, at its rear portion, and enter recycler module 200 between film bands 205. Take-up spools 202, 203 act as a reservoir of film bands 205 from which they are abutted together for storage of notes on drum 220. When recycler module 200 receives note from validation module 100, take-up spools 202, 203 rotate in a clockwise direction (when viewed from the right side), allowing film bands 205 to be routed around wheels 240, 241. As wheels 240, 241 rotate in a counter-clockwise direction, film bands move around wheels 240, 241 and are placed into abutment so as to hold a note as it exits the validation module 100. Drum 220 rotates in a clockwise direction and radially stores received the note.

Figure 9:
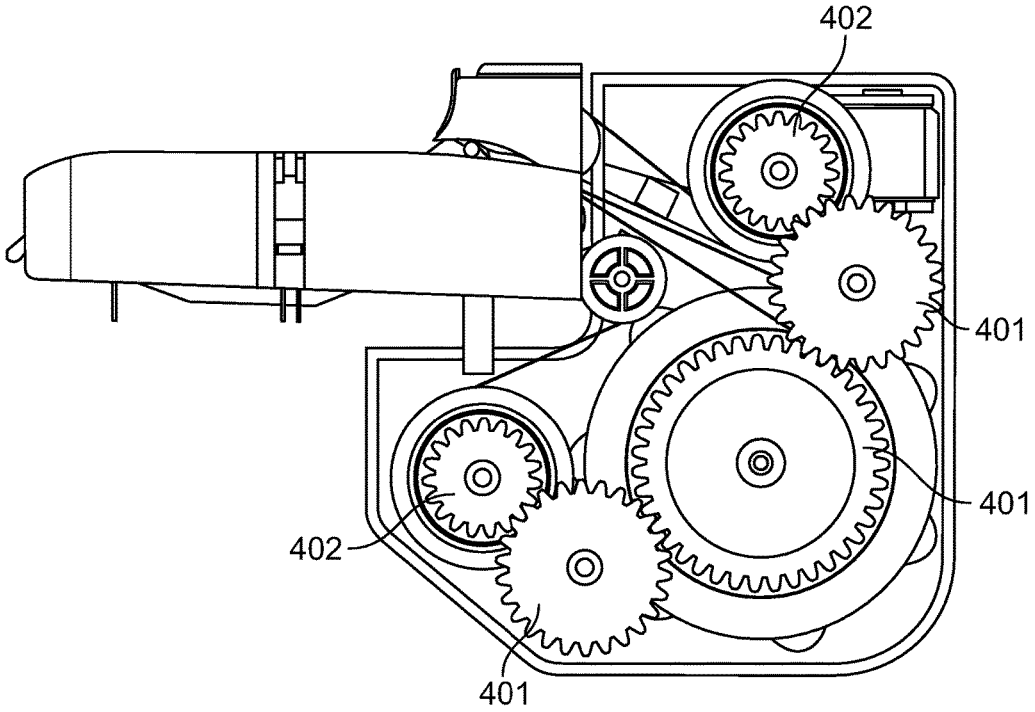
FIG. 9 is a projection view of the recycler of FIG. 8.

Recycler module 200 further includes drive assembly 500 (see FIGS. 8 and 9) for selectively moving notes on and off note recycler 200. In some implementations, springs 402 are operatively coupled to take-up spools 202, 203. Springs 402 are housed within take-up spools 202, 203 and are arranged with drive gears 401, which are operatively engaged with a gear assembly for driving drum 220 in forward and reverse directions. As drive gears 401 rotate in a clockwise direction, the gear assembly causes drum 220 to rotate in a clockwise direction. Clockwise rotation of drum 220 causes inserted notes to be stored radially about drum 220. Counter-clockwise rotation of drum 220 causes notes to be dispensed from the drum. Notes dispensed from drum 220 can be routed back to validation module 100, as part of change in a transaction, or notes can be dispensed from drum 220 to note storage module 300. Notes dispensed from drum 220 also can be routed to validation module 100 as a result of a transaction being cancelled by the customer or when notes are determined to be non-authentic by validation module 100.

Figure 10:
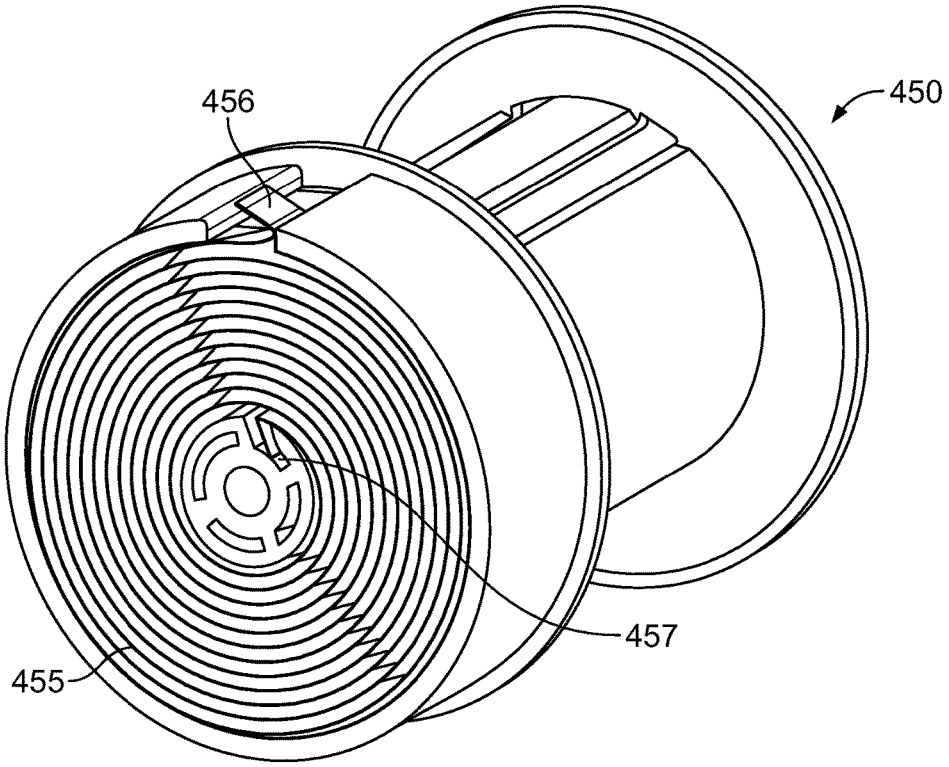
FIG. 10 is a detail view of a take-up drum.

In some implementations, recycler module 200 includes a compensating mechanism 450 (see FIG. 10) for maintaining tension on the notes during receiving and dispensing events. In the illustrated example, compensation mechanism 450 includes spiral springs 455 operatively coupled to take-up spools 202, 203 so as to compensate for angular speed variations between drum 220 and take-up spools 202, 203.

As notes accumulate on drum 220, the diameter of drum 220 increases. An increase in the diameter of drum 220 causes a reduction in angular speed. Conversely, as the number of notes stored on drum 220 decreases, the angular speed of drum 220 increases. Similarly, changes in the amount of film band 205 wound about take-up spools 202, 203 cause variation in the angular speed of take-up spools 202, 203. In order to maintain tension on the notes held between film bands 205, spiral springs 455 allow for variation in angular speed between drum 220 and take-up spools 202, 203 such that proper tension of film bands 205, and thus of the notes, is maintained. Spiral springs 455 are located concentric inside each take-up spool 202, 203. One end 456 of the spiral spring 455 is attached to the take-up drum 202, 203, and the other end 457 is attached to the hub of drive gear 401.

As the layers of film bands 205 wind about drum 220 and unwind from take-up spools 202, 203, the angular speed of storage drum 220 decreases and the angular speed of take-up spools 202, 203 increases as a result of the corresponding reduction of the spool diameter. Spiral springs 455 absorb the angular speed differential.

Figure 11:
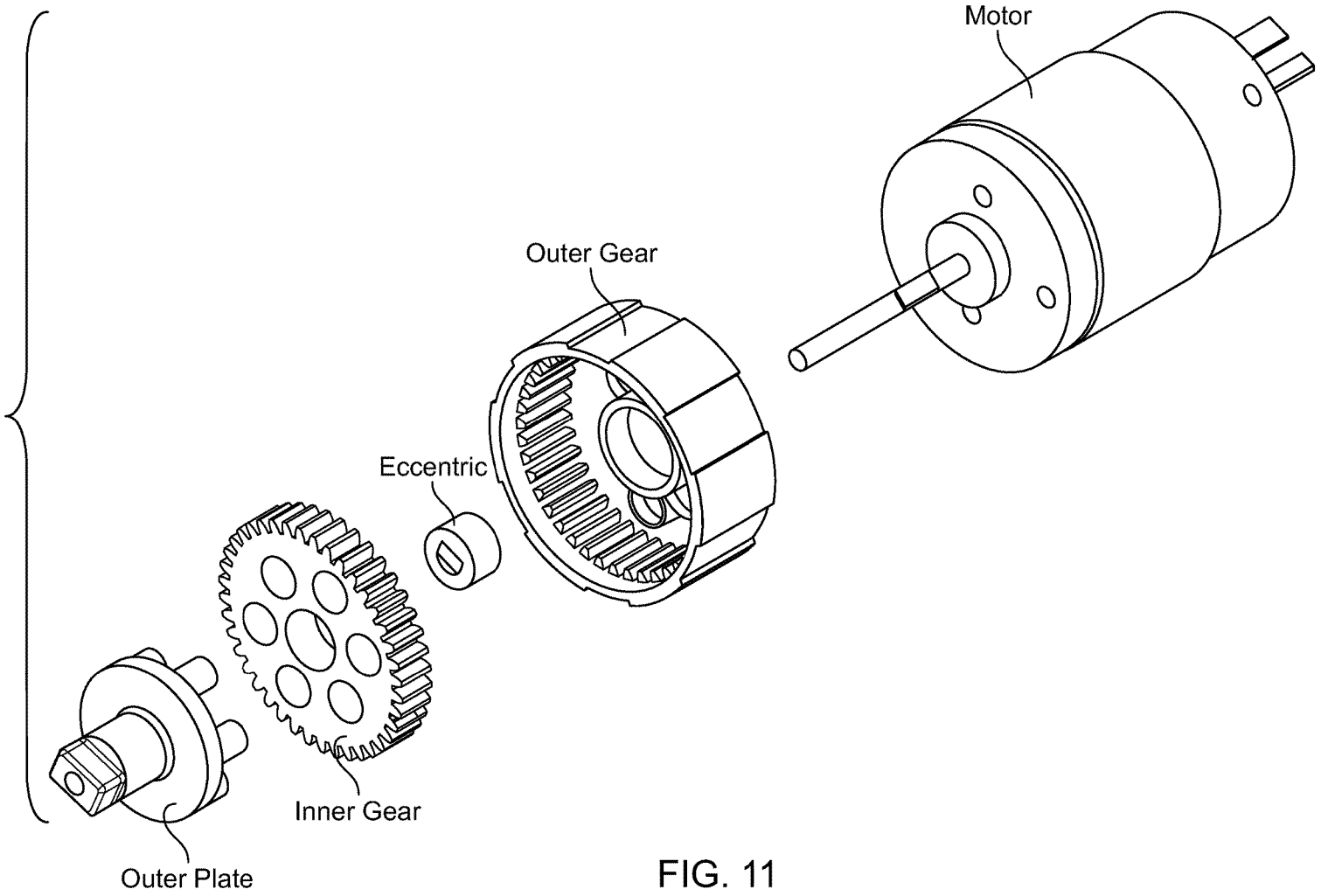
FIG. 11 is an exploded view of a plano-centric speed reducer assembly.

Drum 220 includes a drum motor, an output shaft, and a speed reducing gear assembly. Drum 220 is coupled to the output shaft and speed reducing gear assembly, which is in-turn coupled to the drive motor. In some implementations, the speed reducing gear assembly includes a plano-centric gear box (see FIG. 11). In other implementations, the speed reducing gear assembly includes a planetary gear box.

The angular speed of drum 220 is varied and controlled according to the speed at which a note is delivered from transportation mechanism 140. To ensure tension is maintained on the note during transfer to and from validation module 100 and recycler module 200, it is desirable to have a slightly higher linear speed of drum 220 relative to the linear speed of transportation mechanism 140 for notes entering recycler module 200 and a slightly lower linear speed of drum 220 for a note exiting recycler module 200 and entering validation module 100. By ensuring tension on the notes transitioning between validation module 100 and recycler module 200, buckling of the notes within the junction of validation module 100 and recycler module 200 is avoided. In some implementations, a 10% differential in speed is suitable. In other situations, different speed differentials can be used.

In some implementations, recycler module 200 includes detection sensors for sensing the presence of notes entering and exiting the recycler module 200. In other implementations, recycler module 200 includes note position sensors for sensing and tracking the position of individual notes stored within the recycler module 200.

Figure 4:
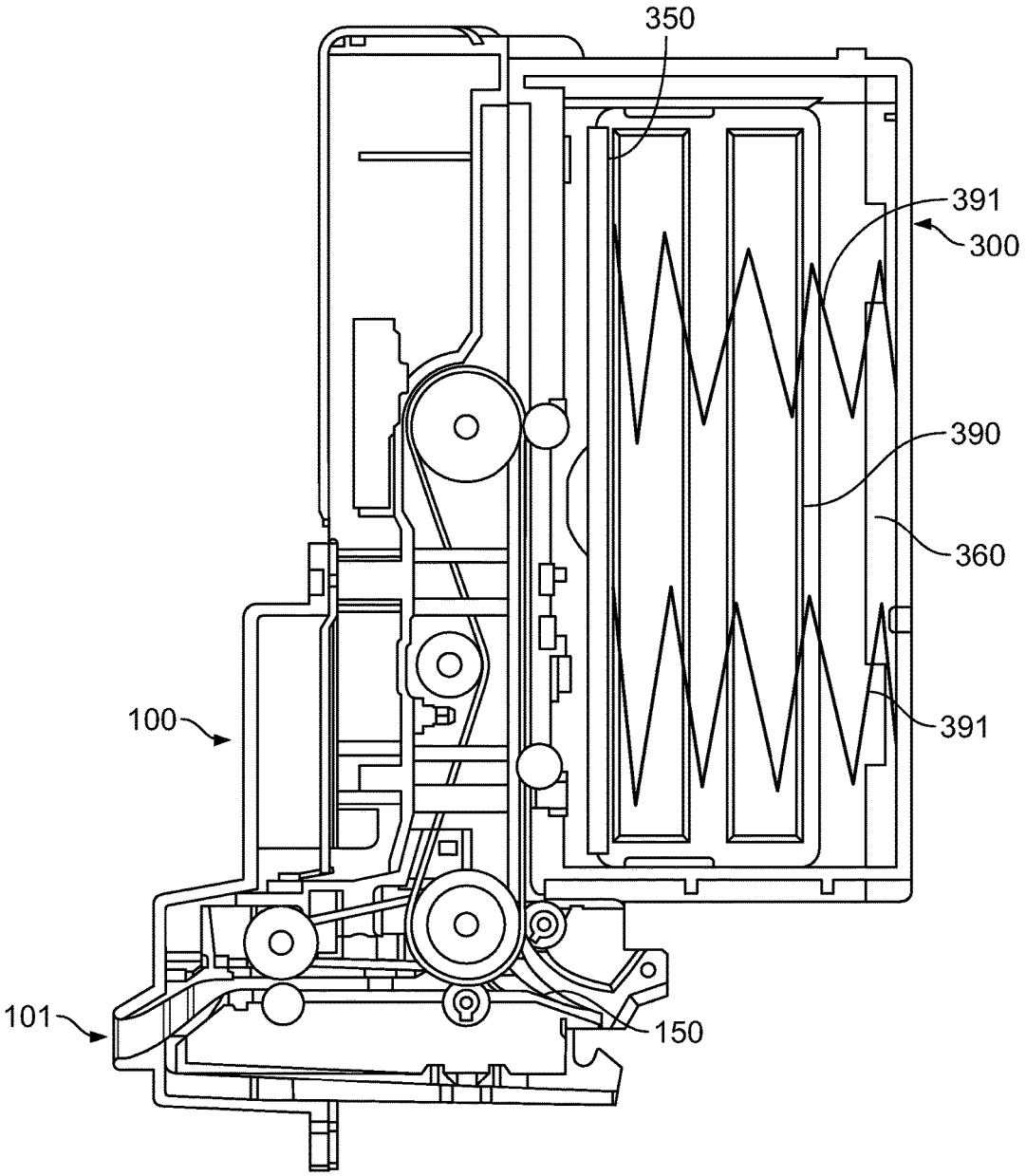

In some implementations, as shown in FIG. 4, the note storage module 300 includes a storage module transportation mechanism, a stacker mechanism 350 and a removable note storage cassette 360. Notes are received from recycler mechanism 200 by the transportation mechanism and are position adjacent an opening to storage cassette 360. Stacker mechanism 350 is arranged to insert notes into storage cassette 360 as is commonly known in the art. Further details of an example of stacker mechanism 350 and storage cassette 360 can be understood from U.S. Pat. No. 5,632,367 (e.g., FIGS. 14, 15 and 16 of the patent). Stacker mechanism 350 includes a scissor-type mechanism that extends into the cassette opening so as to insert a note into cassette 360. In some implementations, storage cassette 360 includes a pressure plate 390 for supporting a stack of notes. Pressure plate 390 is coupled to biasing springs 391 for biasing pressure plate 390 in a direction towards the cassette opening. The cassette opening is arranged such that notes can be inserted into cassette 360 by stacker mechanism 350, and notes stored within cassette 360 cannot be extracted therefrom without removal of storage cassette 360 from money handling device 10.

In operation, the money handling device 10 receives notes from a customer as part of an automated transaction in exchange for goods or services. The following detailed description of the operation of money handling device 10 will be described relative to a single note; however, multiple notes can be inserted sequentially and processed in a similar manner.

A note is inserted into money handling device 10 at note inlet 101 of validation module 100. As the note is inserted into validation module 100, transportation mechanism 140 operates to pass the note through validation module 100 and past sensor assembly 110. Sensor assembly 110 optically inspects the note to determine its authenticity and denomination. In some implementations, sensor assembly 110 uses non-optical techniques (e.g., magnetic inspection) to inspect the note. If the note is deemed not to be authentic, transportation mechanism 140 reverses direction and expels the note out of money handling device 10 through note inlet 101. If the note is deemed to be authentic, transportation mechanism 140 transports the note to recycler module 200 through a generally rearward exit past diverter 150. When validation module 100 transports the note to recycler module 200, diverter 150 is in a first position in which the path between validation module 100 and recycler module 200 is not blocked.

Data from sensor assembly 110 regarding authenticity and denomination of the note is passed to a microprocessor within the validation module 100. Based on the data received by the microprocessor from sensor assembly 110, a determination is made whether or not to store the note within recycler module 200, for later dispensing as change, or to store the note within note storage module 300. The microprocessor can provide instructions to money handling device 10 to store a single common denomination within recycler module 200 or can provide instructions to store multiple denominations within recycler module 200, according to the particular application.

As the note exits validation module 100, the leading edge of the note contacts film bands 205 of recycler module 200. A drum drive motor actuates to rotate drum 220 in a clockwise direction at a linear speed slightly faster that the linear speed of transportation mechanism 140 so as to maintain tension on the note. As the note enters recycler module 200, it is contained therein by the abutment of film bands 205. Continued rotation of drum 220 allows the note to be stored within recycler module 200. In some implementations, the note is held in an escrow position until a determination on authenticity is made by the microprocessor.

Based on instruction from the money handling device, the note can be held temporarily within recycler 200 for later dispensing as change, or recycler module 200 can transport the note to note storage module 300. When a note is selected for storage within recycler module 200, drum 220 continues to rotate in a clockwise direction to position the note for temporary storage. When the note is selected to be stored within storage module 300, diverter 150 is moved from a first position blocking transportation of the note from recycler module 200 to storage module 300, to a second position blocking transportation of the note from recycler module 200 to validation module 100. Once diverter 150 has moved to the second position, the drum drive motor reverses direction and causes drum 220 and take-up spools 202, 203 to rotate in a counter-clockwise direction. As drum 220 rotates in a counter-clockwise direction, film bands 205 causes the note to be dispensed from recycler module 200 and be transitioned into engagement with the transportation mechanism. In order to maintain tension on the note, the drum drive motor moves at a linear speed slightly slower than the linear speed of the transportation mechanism. As the note exits recycler module 200, it is guided by diverter 150 to be received by the transportation mechanism. The transportation mechanism continues to cause the note to travel generally within storage module 300 into a position adjacent cassette opening. Once the note is positioned adjacent the cassette opening, stacker mechanism 350 is actuated to insert the note into storage cassette 360. As stacker mechanism 350 extends and inserts the note into cassette 360, pressure plate 390 is displaced in a direction opposite of a biasing force from biasing springs 391. Once the note has passed through the cassette opening, stacker mechanism 350 is retracted and pressure plate 390 is allowed to move in the biasing direction such that the note is retained within storage cassette 360.

In some implementations, a note can be held is an escrow position adjacent the storage cassette opening. In such cases, the note is inserted into money handling device 10 at note inlet 101 of validation module 100. As the note is inserted into validation module 100, transportation mechanism 140 operates to pass the note through validation module 100 and sensor assembly 110. Sensor assembly 110 optically inspects the note to determine authenticity and denomination. In some implementations, sensor assembly uses non-optical techniques (e.g., magnetic inspection) to inspect the note. If the note is deemed not to be authentic, transportation mechanism 140 reverses direction and expels the note out of money handling device 10 through note inlet 101. If the note is deemed to be authentic, transportation mechanism 140 transports the note to an escrow position adjacent the cassette opening. When the note is transported out of validation module 100 and into note storage module 300, the note is guided by diverter 150 to ensure transition of the note between validation module 100 and note storage module 300. Upon instruction from the microprocessor, the note can be inserted into storage cassette 360 it can be transported to recycler module 200 for temporary storage and later dispensed as change in a transaction.

When the note is selected for temporary storage within recycler module 200, the transportation mechanism is reversed to transport the note from note storage module 300 to recycler module 200. Diverter 150 is moved from a first position, blocking the path between note storage module 300 and recycler module 200, to a second position blocking the path between note storage module 300 and validation module 100. With the diverter 150 in the second position, the transportation mechanism is reversed to transport the note in a generally downward direction. As the note exits note storage module 300, diverter 150 guides the note towards recycler module 200. Upon entry of the note into recycler module 200, the leading edge of the note engages film bands 205 adjacent wheels 240, 241. The note is contained between film bands 205 as it is positioned for temporary storage within recycler module 200. As the note enters recycler module 200, the drum motor operates to cause drum 220, and take-up spools 202, 203 to rotate in a clockwise direction. Clockwise rotation of drum 220 causes film bands 205, and thus the note contained between the bands, to be radially stored about drum 220.

In some implementations, money handling device 10 is arranged to optimize the number of notes stored within recycler module 200. In such cases, the microprocessor can be programmed to monitor the number of notes stored within recycler 200 such that when necessary, a predetermined maximum of notes is maintained within recycler 200. In some implementations, recycler module 200 can be instructed, for example during downtime or in between transactions, to dispense at least some of the notes stored within recycler 200 to note storage module 300.

Figure 13:
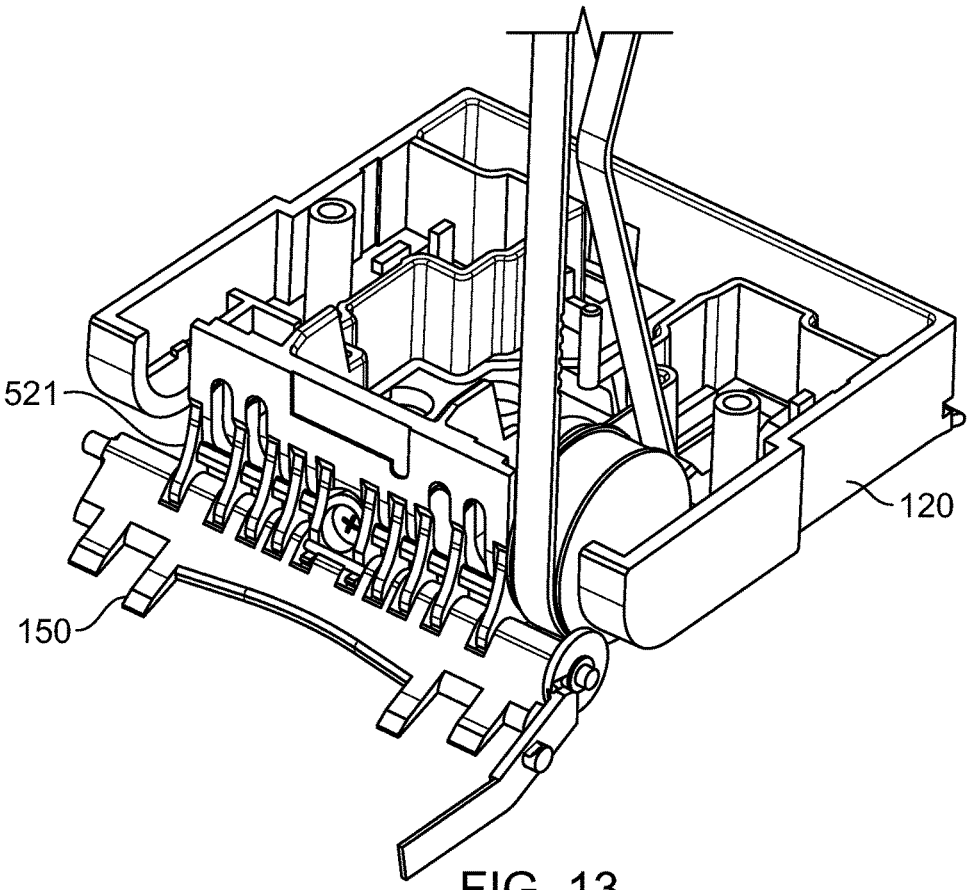
FIG. 13 is a detail view of the diverter engaged with the wedge comb guide.

In some implementations, the diverter 150 is designed as a comb that interleaves with a wedge comb guide 521 (see FIGS. 12 and 13) attached to the rear of the upper housing of the validation unit. The wedge comb guide can be screwed in place to the upper housing so that the housing can be an upgradable universal part. The wedge comb guide 521 serves to close the direct upward path to the stacker and to guide the note toward the diverter 150 and the recycler 200 and prevent the note from going directly to the stacker section.

Other implementations are within the scope of the claims.

What is claimed is:

1. A money handling device capable of accepting, storing and dispensing valuable documents in exchange for goods or services comprising:

a validation module configured to determine acceptable and non-acceptable valuable documents, the validation module comprising an inlet through which the documents are inserted into the money handling device;

a recycler module configured to temporarily store and subsequently dispense an acceptable valuable document, wherein the recycler module comprises a rotary drum configured to temporarily store the acceptable valuable document thereon and a note speed compensation mechanism; and a note storage module configured to store the acceptable valuable document;

wherein the recycler module is configured to selectively dispense a temporarily stored valuable document to the validation module for dispensing as change through the inlet or to the note storage module, and wherein the note speed compensation mechanism is configured to operate at a speed slightly faster than a speed of the validation module when receiving a note from the validation module and to operate at a speed slightly slower than a speed of the note storage module or the validation module when dispensing a note from the recycler module.

2. The money handling device of claim 1, wherein a diverter is pivotally coupled to the validation module.

3. The money handling device of claim 2, wherein the diverter is movable between (i) a first position blocking valuable documents from being transported between the recycler module and the note storage module and (ii) a second position blocking valuable documents from being transported between the recycler module and the validation module.

4. The money handling device of claim 1, wherein the recycler module comprises a film band.

5. The money handling device of claim 1, wherein:

the validation module comprises a sensor assembly configured to test an authenticity and denomination of inserted valuable documents, and the validation module is configured to determine whether an inserted valuable document is acceptable or non-acceptable based on data obtained by the sensor assembly.

6. The money handling device of claim 5, wherein the sensor assembly comprises an optical sensor configured to test optical characteristics of the inserted valuable document.

7. The money handling device of claim 5, wherein the sensor assembly comprises a non-optical sensor configured to test characteristics of the inserted valuable document.

8. The money handling device of claim 1, further comprising a microprocessor configured to control at least one of the validation module, the recycler module or the note storage module.

9. The money handling device of claim 1, wherein the recycler module is removably coupled to the money handling device.

10. The money handling device of claim 1, wherein the note speed compensation mechanism comprises spiral springs.

11. A money handling device capable of accepting, storing and dispensing valuable documents in exchange for goods or services comprising:

a validation module configured to determine acceptable and non-acceptable valuable documents, the validation module comprising an inlet through which the documents are inserted into the money handling device;

a recycler module configured to temporarily store and subsequently dispense an acceptable valuable document, wherein the recycler module comprises a rotary drum configured to temporarily store the acceptable valuable document thereon and a note speed compensation mechanism; and a note storage module including a removable storage cassette configured to store the acceptable valuable document;

wherein the recycler module is configured to dispense a temporarily stored valuable document to the validation module for dispensing as change through the inlet, and wherein the note speed compensation mechanism is configured to operate at a speed slightly faster than a speed of the validation module when receiving a note from the validation module and to operate at a speed slightly slower than a speed of the note storage module or the validation module when dispensing a note from the recycler module.

12. The money handling device of claim 11, wherein a diverter is pivotally coupled to the validation module.

13. The money handling device of claim 12, wherein the diverter is movable between (i) a first position blocking valuable documents from being transported between the recycler module and the note storage module and (ii) a second position blocking valuable documents from being transported between the recycler module and the validation module.

14. The money handling device of claim 11, wherein the recycler module comprises a film band.

* * * * *